US005932969A

United States Patent [19]

Ikeuchi et al.

[11] Patent Number: 5,932,969

[45] Date of Patent: Aug. 3, 1999

[54] DISCHARGE LAMP

[76] Inventors: Mitsuru Ikeuchi, 203-gou, 419 Kokubunji, Mikunino-cho; Hiromitsu Matsuno, 782-1, Nozatoueno-machi; Yukihiro Morimoto, 77 Doushin-machi, all of Himeji-shi, Hyogo-ken, Japan

[21] Appl. No.: 08/901,428

[22] Filed: Jul. 25, 1997

[30] Foreign Application Priority Data

Jul. 25, 1996 [JP] Japan ..... 8-213299

[51] Int. Cl.[6] ..... H01J 61/30; H01J 17/18

[52] U.S. Cl. ..... 313/623; 313/625

[58] Field of Search ..... 313/623, 631, 313/624, 625

[56] References Cited

U.S. PATENT DOCUMENTS 4,795,943 1/1989 Antonis et al. ..... 313/623 X 5,424,609 6/1995 Geven et al. ..... 313/623

5,557,169 9/1996 Van Lierop et al. ..... 313/623

*Primary Examiner*—Ashok Patel

[57] ABSTRACT

To prevent corrosion of the sites where upholding parts of electrodes are attached and to easily effect exact positioning of the electrodes, in a discharge lamp in which the sealing tubes of a discharge vessel are sealed with sealing bodies of material with a gradient function which is formed from a dielectric powder of the same material as material of the discharge vessel and from a conductive powder, the upholding parts of the electrodes extend through axial openings which are formed in the sealing bodies and are attached and hermetically sealed on the outer faces of the sealing bodies by means of a solder or the like.

5 Claims, 1 Drawing Sheet

DISCHARGE LAMP

BACKGROUND OF THE INVENTION

1. Field of the Invention

The invention relates to a discharge lamp in which the ends of the discharge vessel are sealed with a material with a gradient function. One end of this material with a gradient function is electrically conductive and the other end is dielectrical. On one end, a dielectric component prevails, and proceeding in the direction toward the other end, the electrically conductivity continuously or incrementally increases until it is electrically conductive.

2. Description of the Related Art

In a discharge lamp within a spherical or ellipsoidal arc tube, in the middle of the quartz glass discharge vessel, there is a pair of opposed electrodes, and an emission metal, such as mercury or the like, and a discharge gas and the like are encapsulated. Cylindrical sealing tubes are joined to opposite ends of the arc tube, and upholding parts of the electrodes and outer lead pins are sealed, in an electrically connected state, by these sealing tubes. However, sealing cannot be achieved by direct welding of the sealing tubes to the upholding parts of the electrodes, since the molybdenum upholding parts of the electrodes and the quartz glass sealing tubes have very different coefficients of thermal expansion. Therefore, the sealing tubes were conventionally sealed by a step joining process, a foil sealing process, or the like.

In the step joining process, intermediate glass tubes of various types are prepared; their coefficients of thermal expansion proceed from the coefficient of thermal expansion of quartz glass, incrementally, until they approach the coefficient of thermal expansion of tungsten. These intermediate glass tubes are welded in stages proceeding from the two ends of the sealing tubes of the discharge vessel, as a result of which the length of the sealing tubes is increased. The glass tubes on the ends with a coefficient of thermal expansion nearest the coefficient of thermal expansion of tungsten are welded to the upholding parts of the electrodes. If fewer intermediate glass tubes are used, the differences between the coefficient of thermal expansion of the adjacent intermediate glass tubes become greater; this causes low mechanical strength at the joining sites, low resistance to thermal shocks, and a reduction of reliability. It is therefore necessary to increase the number of intermediate glass tubes.

Furthermore, at a high temperature, e.g., greater than or equal to 400° C., in luminous operation, oxidation of tungsten occurs because the tungsten rods and the glass ends are in contact with air. Here, there is the danger of leakage and breakage. The length of the sealing tubes in the axial direction is increased and multiple joining sites are formed, so that reliability is reduced accordingly.

In the foil sealing process, the ends of the upholding parts of the electrodes and the outer lead pins are welded to the two of molybdenum foils having a thickness of a few dozen microns. These molybdenum foils are clamped between quartz glasses, and sealing tubes of quartz glass are welded to the center area of the molybdenum foils. In this foil sealing process, at a high temperature of greater than or equal to 350° C. in luminous operation, oxidation of the molybdenum foils occurs because the ends of the molybdenum foils to which the outer lead pins are welded are in contact with air. Here, a leak occurs due to loosening of the seal areas as a result of expansion by oxidation or breakage. This means that, in the seal areas on the ends of the sealing tubes, the temperature increase must be suppressed. Therefore, it necessary to lengthen the sealing tubes, and thus, the distance between the seal areas and the arc tubes whose temperature during luminous operation increases.

In the case of a discharge lamp using mercury vapor, when the distance between the arc tube and the seal areas is increased, the tube wall temperature drops on the base points of the upholding parts of the electrodes. This means that the temperature of the coolest part within the arc tube becomes too low, and the mercury does not vaporize sufficiently. Therefore, it becomes necessary to provide the outside of the tube wall at the base points of the upholding parts of the electrodes with a heat insulating film and thus to effect heat insulation. But here, it is considered disadvantageous that the light is shielded by this heat insulating film and that the lighting efficiency decreases.

By means of the step joining process or foil sealing process, the sealing tubes of the discharge lamp are lengthened in the axial direction in this way. In a light irradiation device in which one of the sealing tubes of a discharge lamp of the short arc type is installed in the center opening of a concave reflector, and in which another sealing tube extends in the direction of the optical axis of the concave reflector, there is however the disadvantage of a decrease in the efficiency of the light due to the long length of the sealing tube, which extends in the direction of the optical axis of the concave reflector, so that some of the light reflected by the concave reflector is incident on this sealing part and shielded.

Recently, a discharge lamp has become more and more important in which the sealing tubes on the ends of the discharge vessel are sealed by sealing bodies which are made of a material with a gradient function which is formed from a dielectric powder, such as silicon dioxide, and a conductive powder, such as molybdenum. In a sealing body which is made of a material of this type with a gradient function, one end is rich in the dielectric component, such as silicon dioxide, while in the direction to the other end, the ratio of the conductive component, such as molybdenum, increases continuously or in stages. Therefore, the vicinity of one end of the sealing body is dielectric and has a coefficient of thermal expansion which approaches the coefficient of thermal expansion of quartz glass. The vicinity of the other end is conductive and has the property that its coefficient of thermal expansion approaches the coefficient of thermal expansion of molybdenum.

For this material with a gradient function, it is possible to increase the gradient with which the ratio of the dielectric component to the conductive component changes. The sealing body made of the material with the gradient function can, therefore, have the dielectric material in a considerable amount on one end and the conductive material in a considerable amount on other end, even if the length is relatively short in the axial direction. Furthermore, the material with the gradient function has no interface on which the composition of its material components changes significantly. Therefore, here, the resistance to thermal shocks and the mechanical strength are great.

Therefore, the seal areas in which the sealing bodies are welded to the sealing tubes can also approach the arc tube which reaches a high temperature in luminous operation. The advantages arise that the sealing bodies have a short length in the axial direction and that, furthermore, the sealing tubes are made shorter. Therefore, the above described disadvantages in the foil sealing process and the step joining process can be eliminated.

As is shown in FIG. 2, conventionally, at the sealing of sealing tubes 12, joined at the opposite ends of an arc tube 11 of a discharge vessel 10, by means of sealing bodies 50 which are made of a material with a gradient function, end faces 51 of sealing bodies 50, which contains a dielectric component, such as silicon dioxide, in a considerable amount, are directed toward the arc tube 11 and sealing bodies 50 are inserted into sealing tubes 12. The neighboring areas of faces 51 are heated and sealing bodies 50 are welded to sealing tubes 12. Furthermore, openings are provided proceeding from the opposite inner and outer end faces 51, 52 of sealing bodies 50 to the areas of electrical conductively. An upholding part 21 of the anode 20 and an upholding part 31 of cathode 30 are inserted and attached in the respective openings of inner end faces 51, and an anode terminal 22 and a cathode terminal 32 are inserted and attached in the respective opening of the respective outer face 52. In this way, the upholding part 21 is electrically connected to anode terminal 22 and the upholding part 31 to cathode terminal 32. The upholding part 21 and the upholding part 31 are, furthermore, often attached by means of solder 60 in sealing bodies 50.

Here, as was described above, sealing tubes 12 are shortened and sealing bodies 50 are brought near to arc tube 11, which reaches a high temperature in luminous operation. The sites attached by means of the solder 60, therefore, are often corroded by plasmas which form during discharge or by discharge gas with an increased temperature. There are cases in which impurity gases and the like form in these attachment sites and have an adverse effect on the lamp characteristics, or shorten the lamp service life.

Furthermore, in a discharge lamp, especially one of the short arc type, it is necessary to exactly fix the positions of the electrodes and to exactly control the distance between the electrodes. If the sealing bodies in which the upholding parts of the electrodes are attached are welded to the sealing tubes, it is, however, difficult to exactly fix the positions of the sealing bodies. Therefore, the disadvantage arises that the positions of the electrodes are often inexact.

In a sodium high pressure lamp, in an arc tube made of transparent aluminum oxide, sealing bodies of aluminum oxide are inserted which are penetrated by power supply wires of niobium which are hermetically sealed to the outer faces of the sealing bodies by sealing glass. In a lamp of this type, there is no process in which the glass is flame-welded. Therefore, the above described disadvantage that the positions of the electrodes are often inexact does not arise.

SUMMARY OF THE INVENTION

Therefore, a primary object of the present invention is to devise a discharge lamp in which corrosion does not occur at the sites at which the upholding parts of the electrodes are attached, and in which accurate positioning of the electrodes is also easily achieved.

In a discharge lamp in which a pair of opposed electrodes are arranged in an arc tube of a discharge vessel of dielectric material, within a discharge gas is encapsulated, and in which cylindrical sealing tubes formed on ends of the arc tube are sealed by sealing bodies of a material with a gradient function, which is formed by mixing a dielectric powder of the same material as the material of the discharge vessel and a conductive powder, the mixing ratios varying continuously or incrementally in the longitudinal direction so that one end is dielectric and an opposite end is conductive, the object according to the invention is achieved by the sealing bodies being provided with through openings in the axial direction which are penetrated by the upholding parts of the electrodes, and by the sealing bodies and the upholding parts of the rods being attached hermetically tight on outer end faces of the sealing bodies.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
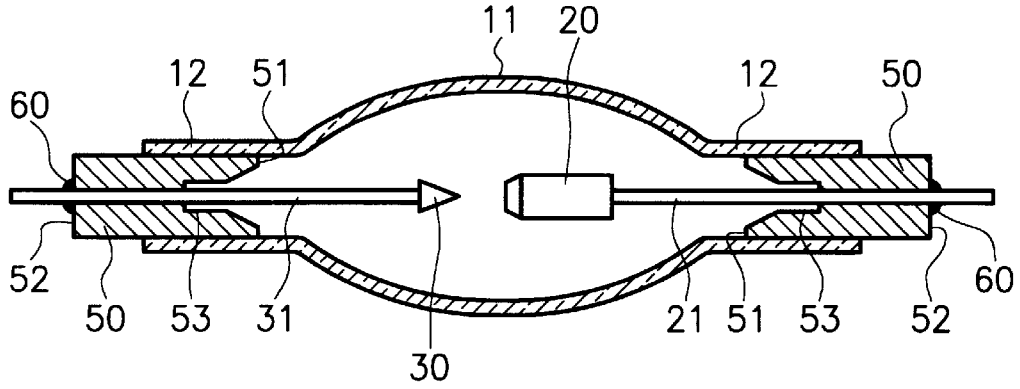
FIG. 1 is a schematic depiction of one embodiment of the invention.
Figure 2:
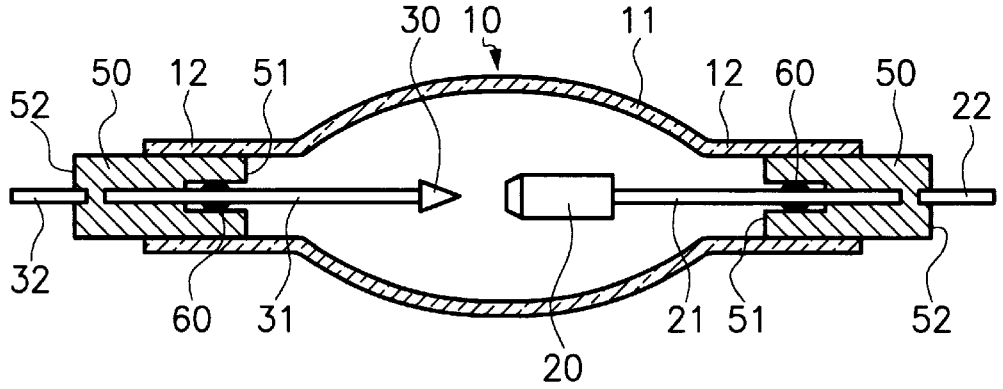
FIG. 2 (Prior Art)
FIG. 2 is a schematic depiction of a conventional example.

FIG. 1 shows a xenon short arc lamp with a nominal wattage of 3 kW which is operated using a direct current. The discharge lamp according to the invention is, however, not limited thereto. A discharge lamp such as a mercury lamp or metal halide lamp can also be used. Furthermore, a discharge lamp of the long arc type or a lamp which is operated using an alternating current can also be used.

FIG. 1 shows an arc tube 11 of a quartz glass discharge vessel 10 which is spherically or elliptically shaped. An anode 20 and a cathode 30 made of tungsten are disposed opposite each other within arc tube 11, for example, spaced 5 mm apart, and furthermore, xenon gas is encapsulated within arc tube 11 at a predetermined pressure and serves as the discharge gas. Sealing tubes 12, are joined to opposite sides of arc tube 11. The sealing tubes 12 are sealed by sealing bodies 50 of a material with a conductivity gradient function.

The material with a gradient function used here is formed of a sintered mixture of a powder of a material which is identical to the material of the discharge vessel and of a conductive powder. For example, in the case in which the discharge vessel is made of quartz glass, a mixture of silicon dioxide powder and molybdenum powder is sintered. Here, the mixing ratios in the longitudinal direction vary continuously or incrementally from one end to the other with one end being dielectric, while the other end is conductive. For example, dielectric faces 51 of sealing bodies 50 consist essentially of 100% silicon dioxide, while conductive faces 52 are a composition which is comprised of 50% $SiO_2$ and 50% Mo. The ratios of the composition, however, are not always limited thereto.

Sealing bodies 50 are inserted into sealing tubes 12 in such a way that dielectric faces 51 are located facing into arc tube 11. The sealing bodies 50 are welded to quartz glass sealing tubes 12 at the locations of these faces 51. Upholding part 21 of anode 20 and upholding part 31 of cathode 30 are molybdenum rods which are inserted through axial openings 53 which are formed through the sealing bodies 50 so that they project beyond the outer faces 52 of the sealing bodies 50. In this state, an electrical connection is obtained on the outer ends of sealing bodies 50. Furthermore, the anode rod 21 and cathode rod 31 are attached in a hermetically sealed manner on the conductive faces 52 of sealing bodies 50 by means of solder 60. The coefficient of thermal expansion of conductive faces 52 of sealing bodies 50 approaches the coefficient of thermal expansion of the molybdenum of the upholding parts 21 and 31, and as a result, the upholding parts 21, 31 can be reliably attached to the sealing bodies 50.

Additionally, instead of the solder sealing glass can be used which has a coefficient of thermal expansion approaching the coefficient of thermal expansion of molybdenum and an effective attachment can still be achieved. Alternatively, the sites attached by the solder can be hermetically sealed to the sealing glass. Using solder, an attachment can be achieved that is stronger than that obtainable with sealing glass. However, the sealing glass has good sealing performance. Therefore, by simultaneous use of the solder and the sealing glass, a hermetic attachment can be even better ensured.

Figure 3:
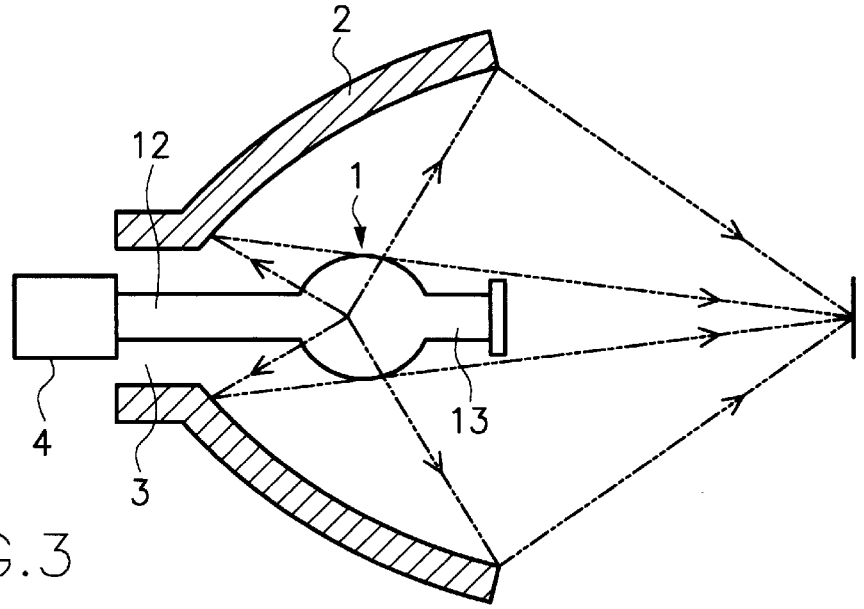
FIG. 3 is a schematic depiction of the discharge lamp according to the invention combined with a concave reflector.

In the above described embodiment, the two sealing tubes 12 on opposite sides of the arc tube 11 are sealed with sealing bodies 50 of a material with a conductivity gradient function. However, an arrangement is also possible in which only one of the sealing tubes is sealed with the sealing body of material with the gradient function. This case is especially preferred when the discharge lamp is a short arc lamp and when it is combined with concave reflector 2, as is shown in FIG. 3. Here, sealing tube 12 on the cathode side is inserted in middle opening 3 of concave reflector 2 and attached. The arc bright spot of short arc lamp 1 is located at the focal point of concave reflector 2. Furthermore, sealing tube 13 on the anode side is arranged such that it extends on the open side of concave reflector 2.

In this case, the sealing tube 13 on the anode side is sealed with the sealing body according to the invention made of a material with a gradient function. However, the sealing tube 12 on the cathode side sealing is sealed by a conventional step joining process of the type mentioned in the Background portion, above. As a result of the extremely short length of sealing tube 12 on the cathode side, the ratio of shielding of the light from sealing tube 12 reflected by concave reflector 2 is extremely small. Thus the efficiency of the light can be greatly increased.

Furthermore, sealing body 50 has a shape in which the dielectric faces 51 taper in a direction toward the arc tube 11, as is shown in FIG. 1. By means of this shape, sealing body 50 can be completely, and at the same time advantageously, welded to quartz glass sealing tubes 12.

In the above described embodiment, a discharge lamp is described in which the sealing tubes are joined to opposite sides of the arc tube (with bilateral seals, i.e., so-called double end type). However, a discharge lamp can be used with a unilateral hermetic seal (so-called hermetically sealed single end type) in which a sealing tube 12 is joined only to one side of the arc tube 11.

The dielectric powder of the material with the gradient function is made of the same material as the material of the discharge vessel. Therefore, besides the above described silicon dioxide powder, for example ceramic powder can also be used in the case in which the discharge vessel is formed of ceramic. It goes without saying that a powder of a suitable metallic conductive material, such as nickel or tungsten, can also be used as the conductive powder, instead of molybdenum powder.

As was described above, the upholding parts 21, 31 and sealing bodies 50 are attached on faces 52, i.e., on the outer faces of sealing body 50. Therefore, no effects act on the attached sites due to the plasmas formed during discharge or as a result of the high temperature discharge gas. Also, formation of impurity gases or the like due to corrosion of the attachment sites and the resulting adverse effects on the lamp characteristics and shortening of the lamp service life do not occur. Furthermore, using the measure by which, first of all, the positions of electrodes 20 and 30 are fixed, and by which only afterwards are upholding parts 21, 31 attached to sealing bodies 50, exact positioning of the electrodes can be obtained.

ACTION OF THE INVENTION

As was described above, in the discharge lamp according to the invention, the sealing tubes of the discharge vessel are sealed with the sealing bodies of a material having a gradient function and which are formed from a dielectric powder of the same material as the discharge vessel and a conductive powder. Furthermore, according to the invention, the upholding parts of the electrodes are inserted through axial openings which are formed through the sealing bodies. In this way, the sealing bodies and the upholding parts of the electrodes are attached, hermetically sealed on the outer faces of the sealing bodies. This prevents corrosion of the sites where the upholding parts of the electrodes are attached and a discharge lamp can be obtained in which exact positioning of the electrodes is also easily effected.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. Discharge lamp comprising an arc tube of a discharge vessel which is made of a dielectric material;

a pair of opposed electrodes and discharge gas encapsulated within the arc tube;

cylindrical sealing tubes formed on opposite sides of the arc tube; and a sealing body disposed within each of the sealing tubes, the sealing body being made of a material with a gradient function which is formed of a mixture of a dielectric powder of the same material as that of the discharge vessel and a conductive powder in mixing ratios which vary in conductivity in a longitudinal direction from a first end which is dielectric and to a second end which is conductive;

wherein each sealing body is provided with an opening extending axially therethrough; and wherein an upholding part of the electrode of a respective one of said opposed electrodes extends through the opening of each sealing body in direct electrically conductive contact with the sealing body.

2. Discharge lamp according to claim 1, wherein the sealing bodies and upholding parts of the electrodes are attached and hermetically sealed with a solder at each attachment site.

3. Discharge lamp according to claim 1, wherein the sealing bodies and upholding parts of the electrodes are attached and hermetically sealed with a sealing glass at each attachment site.

4. Discharge lamp according to claim 1, wherein the sealing bodies and upholding parts of the electrodes are attached and hermetically sealed with a solder at each attachment site; and wherein each attachment site is surrounded and hermetically sealed with a sealing glass.

5. Discharge lamp according to claim 1, wherein the upholding parts of the electrodes are attached and hermetically sealed at an attachment site on an outer face of the sealing body.

* * * * *

UNITED STATES PATENT AND TRADEMARK OFFICE

CERTIFICATE OF CORRECTION

PATENT NO. : 5,932,969

DATED : August 3, 1999

INVENTOR(S) : Mitsuru Ikeuchi, et al.

It is certified that error appears in the above-identified patent and that said Letters Patent is hereby corrected as shown below:

On the title page, item [73] Assignee, should read:

Assignee: Ushiodenki Kabushiki Kaisha, Tokyo, Japan

Add Attorney, Agent or Firm:
Sixbey, Friedman, Leedom and Ferguson; David S. Safran Signed and Sealed this Twenty-first Day of December, 1999

*Attest:*

Q. TODD DICKINSON

*Attesting Officer*

*Acting Commissioner of Patents and Trademarks*